US010463163B1

(12) United States Patent
Aramli et al.

(10) Patent No.: US 10,463,163 B1
(45) Date of Patent: Nov. 5, 2019

(54) ADJUSTABLE POWER BED LAYER

(71) Applicant: BEDJET LLC, Newport, RI (US)

(72) Inventors: Mark Darius Aramli, Newport, RI (US); Ryan Almeida, Newport, RI (US)

(73) Assignee: BEDJET LLC, Newport, RI (US)

( * ) Notice: Subject to any disclaimer, the term of this patent is extended or adjusted under 35 U.S.C. 154(b) by 0 days.

(21) Appl. No.: 16/422,666

(22) Filed: May 24, 2019

(51) Int. Cl.

| | |
|---|---|
| ***A47C 20/04*** | (2006.01) |
| ***A47C 19/12*** | (2006.01) |
| ***A61G 7/015*** | (2006.01) |
| ***A61G 13/08*** | (2006.01) |

(52) U.S. Cl.
CPC ..... *A47C 20/041* (2013.01); *A47C 19/122* (2013.01); *A61G 7/015* (2013.01); *A61G 13/08* (2013.01)

(58) Field of Classification Search
CPC ..... A61G 7/002; A61G 7/005; A61G 7/012; A61G 7/015; A61G 7/018; A61G 13/02; A61G 13/04; A61G 13/06; A61G 13/08; A47C 20/04; A47C 20/041; A47C 20/08; A47C 19/005; A47C 19/021; A47C 19/12; A47C 19/122
USPC ... 5/613, 616, 617, 618, 620, 600, 610, 174, 5/200.1, 201, 202
See application file for complete search history.

(56) References Cited

U.S. PATENT DOCUMENTS

| | | | | | |
|---|---|---|---|---|---|
| 1,658,736 | A * | 2/1928 | Ortmeier | A61G 7/002 | 5/617 |
| 2,285,474 | A * | 6/1942 | Urie | A47C 20/08 | 5/618 |
| 2,517,466 | A * | 8/1950 | Cox | A61G 7/015 | 5/614 |
| 2,631,300 | A * | 3/1953 | Murray | A47C 20/041 | 5/616 |
| 3,456,269 | A * | 7/1969 | Goodman | A47C 19/122 | 5/152 |
| 3,644,946 | A * | 2/1972 | Swatt | A47C 20/041 | 5/616 |
| 3,898,702 | A * | 8/1975 | Goodman | A61G 7/015 | 5/618 |
| 4,361,917 | A * | 12/1982 | Wilson | A47C 20/041 | 5/616 |
| 4,563,784 | A * | 1/1986 | Shrock | A47C 17/17 | 297/342 |
| 4,685,160 | A * | 8/1987 | Rizzardo | A47C 19/005 | 5/201 |

(Continued)

*Primary Examiner* — Robert G Santos
(74) *Attorney, Agent, or Firm* — Robert J. Hess; Hess Patent Law Firm

(57) ABSTRACT

An adjustable power bed layer that has a bed frame that folds from a flattened state to a folded state and from a flattened state to an adjusted state. The bed frame has an inner and outer frame that nest with each other in the flattened state. Head side and foot side actuators drive sliding members back and forth along respective tracks to pivot respective articulating frames between the flattened and adjusted states. The articulating frames are part of one of the inner and outer frames and the tracks are connected to the other of the inner and outer frames. In the folded state, the bed frame is positioned to that one of head side and foot side actuators becomes accessible for maintenance and servicing from above depending upon which way the bed frame is folded about its folding pivot.

18 Claims, 19 Drawing Sheets

(56) References Cited

U.S. PATENT DOCUMENTS 4,756,034 A * 7/1988 Stewart ..... A47C 17/1753 5/37.1
5,090,071 A * 2/1992 Bathrick ..... A47C 19/122 5/174
5,165,129 A * 11/1992 Rohm ..... A61G 7/015 5/613
5,257,428 A * 11/1993 Carroll ..... A47C 19/122 5/201
5,438,723 A * 8/1995 Carroll ..... A47C 19/122 16/267
5,537,701 A * 7/1996 Elliott ..... A47C 19/005 5/616
5,577,279 A * 11/1996 Foster ..... A61G 7/00 5/602
5,577,280 A * 11/1996 Elliott ..... A47C 19/005 5/617
5,640,730 A * 6/1997 Godette ..... A47C 20/041 5/617
5,708,997 A * 1/1998 Foster ..... A61G 7/00 5/613
5,870,784 A * 2/1999 Elliott ..... A47C 19/005 5/616
5,933,888 A * 8/1999 Foster ..... A61G 7/05784 5/600
6,006,379 A * 12/1999 Hensley ..... A47C 20/041 5/616
6,076,210 A * 6/2000 Wu ..... A47C 19/122 5/174
6,088,853 A * 7/2000 Jansen ..... A47C 20/041 5/616
6,112,345 A * 9/2000 Foster ..... A61G 7/05784 5/503.1
6,209,157 B1 * 4/2001 Hensley ..... A47C 20/041 5/613
6,276,011 B1 * 8/2001 Antinori ..... A47C 20/041 5/613
6,374,436 B1 * 4/2002 Foster ..... A61G 7/0015 5/624
6,393,641 B1 * 5/2002 Hensley ..... A47C 20/041 5/613
6,516,479 B1 * 2/2003 Barbour ..... A47C 19/045 5/152
6,694,548 B2 * 2/2004 Foster ..... A61G 7/0015 135/67
6,708,358 B2 * 3/2004 Hensley ..... A47C 20/041 5/613
6,725,474 B2 * 4/2004 Foster ..... A61G 7/0015 5/604
7,484,254 B2 * 2/2009 Eriksson ..... A47C 20/041 5/618
7,530,125 B2 * 5/2009 Neuenswander .... A47C 20/041 5/616
7,900,302 B2 * 3/2011 Long ..... A47C 20/08 5/617
8,042,210 B2 * 10/2011 Clenet ..... A61G 7/015 5/600
8,407,837 B1 * 4/2013 Huang ..... A61G 7/002 5/116
8,935,817 B2 * 1/2015 Suh ..... A47C 19/122 5/174
9,009,896 B2 * 4/2015 Suh ..... A47C 19/122 5/618
10,213,027 B2 * 2/2019 Lo ..... A47C 19/122
2001/0000828 A1 * 5/2001 Hensley ..... A47C 20/041 5/618
2002/0116760 A1 * 8/2002 Foster ..... A61G 7/0015 5/81.1 R
2002/0144350 A1 * 10/2002 Shih ..... A47C 20/041 5/620
2003/0019036 A1 * 1/2003 Foster ..... A61G 7/0015 5/430
2007/0163046 A1 * 7/2007 Eriksson ..... A47C 20/041 5/618
2009/0019640 A1 * 1/2009 Neuenswander .... A47C 20/041 5/618
2009/0094748 A1 * 4/2009 Long ..... A47C 20/041 5/613
2009/0178201 A1 * 7/2009 Lujan ..... A47C 20/027 5/618
2009/0211028 A1 * 8/2009 Richmond ..... A47C 20/041 5/618
2010/0199433 A1 * 8/2010 Clenet ..... A61G 7/015 5/618
2013/0312185 A1 * 11/2013 Suh ..... A47C 20/043 5/618
2014/0250599 A1 * 9/2014 Cassell ..... A61G 7/015 5/613
2014/0366267 A1 * 12/2014 Suh ..... A47C 20/041 5/174
2018/0116413 A1 * 5/2018 Lo ..... A47C 19/122
2019/0125089 A1 * 5/2019 Aramli ..... A47C 20/04

* cited by examiner

ADJUSTABLE POWER BED LAYER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

Field of the Invention

The invention relates to an adjustable power bed layer, preferably a bedframe equipped with a head frame that can raise a head of a mattress and equipped with a foot frame that can raise a foot of the mattress. The adjustable power bed layer has no legs and may be placed directly on any flat surface, box spring, platform bed or bed frame. The legless design in which the adjustable bed power layer can rest on any flat surface, box spring, platform bed or bed frame represents a dramatic improvement for the consumer in allowing them to use. For example, platform beds with storage drawers cannot accept any type of adjustable bed with legs, as the legs would physically interfere with the location and operation of the drawers.

Discussion of Related Art

A nested bedframe assembly is one in which an articulating portion of the frame is nested within the same plane as the fixed support structure of the frame (i.e., the section with the legs). Many conventional designs don't nest at all—the articulating portion rests on top of the fixed support structure of the frame with the legs. They don't care about dimensional height issues because their designs are complete, free standing, bed platforms with legs. These free standing adjustable bed designs typically will have actuator assemblies or other moving parts projecting below their frames, making it impossible to operate them on flat surfaces without legs.

An example of a nested frame is in United States Patent Application Publication No. 2014/0366267, which discloses a motorized foldable bed frame assembly configured to fold from an open co-planar assembly to a closed parallel assembly. Such may be a dual-actuating adjustable bed frame, which is collapsible and foldable for ease of shipping. It may be configured for use by extending pivoting frame sections and engaging collapsible support legs and may include a head adjustable frame, or a head and foot adjustable frame. It nests the articulating portion within the inner area of the fixed support structure with the legs.

SUMMARY OF THE INVENTION

One aspect of the invention resides in a folding adjustable bed platform that can nest an articulating portion of the platform on the outer section of a fixed support structure, although the nesting could be configured instead vice versa.

No legs are required so as to sit the folding adjustable bed platform on any flat surface, box spring, platform bed or bedframe with a distributed support structure.

An actuator imparts its force to a moving/articulating linkage, or connected structure that then lifts the articulating portion of the frame vs. actuator imparting force directly to the articulating portion of the frame via fixed points.

Another aspect of the invention resides in an adjustable power bed layer and method of assembly thereof. The adjustable power bed layer includes two support frames pivotally connected to each other and configured to fold one over another into a folded orientation from a flattened, spread apart orientation. There are two articulating frames pivotally connected to the two support frames respectively to each pivot from a respective flattened orientation to a respective deployed orientation. There are two actuators that are fixed within a respective plane in common with the associated two support frames and that carry out sliding movement without any movement or projection below the plane of the support frame. There are two connected structures movable each back and forth within the associated ones of the two support frames to cause the two articulating frames to move between their flattened and deployed orientations.

The two articulating frames in their flattened orientation are nested with the two support frames in the flattened, spread apart orientation. The two articulating frames in their deployed orientation define respective acute angles of inclination with associated ones of the two support frames from which the two articulating frames extend so that the two articulating frames extend from the two support frames in a diverging manner relative to each other with the two support frames in their flattened, spread apart orientation.

One of the two articulating frames has two portions pivotally connected to each other with one of the two portions defining the acute angle of inclination in the deployed orientation accordingly and the other of the two portions pivoting to define a reflex angle of inclination with the one of the two portions.

Each of the two support frames are equipped with respective tracks along which the two connected structures respectively slide back and forth to move associated ones of the two articulating frames between the flattened and deployed orientations.

A linkage or connected structure is arranged so that one of the two actuators imparts a force against the linkage that causes the linkage in turn to apply the imparted force onto one of the two articulating frames to move same.

In the folded orientation, the two support frames are arranged one over another so as to render accessible from above one of the two actuators that is associated with whichever one of the two support frames is over the other.

The two support frames lack legs extending underneath from the two support frames in their flattened, spread apart orientations and possess no linkages connected to legs.

BRIEF DESCRIPTION OF THE DRAWINGS

For a better understanding of the present invention, reference is made to the following description and accompanying drawings, while the scope of the invention is set forth in the appended claims.

DETAILED DESCRIPTION OF THE INVENTION

Figure 1:
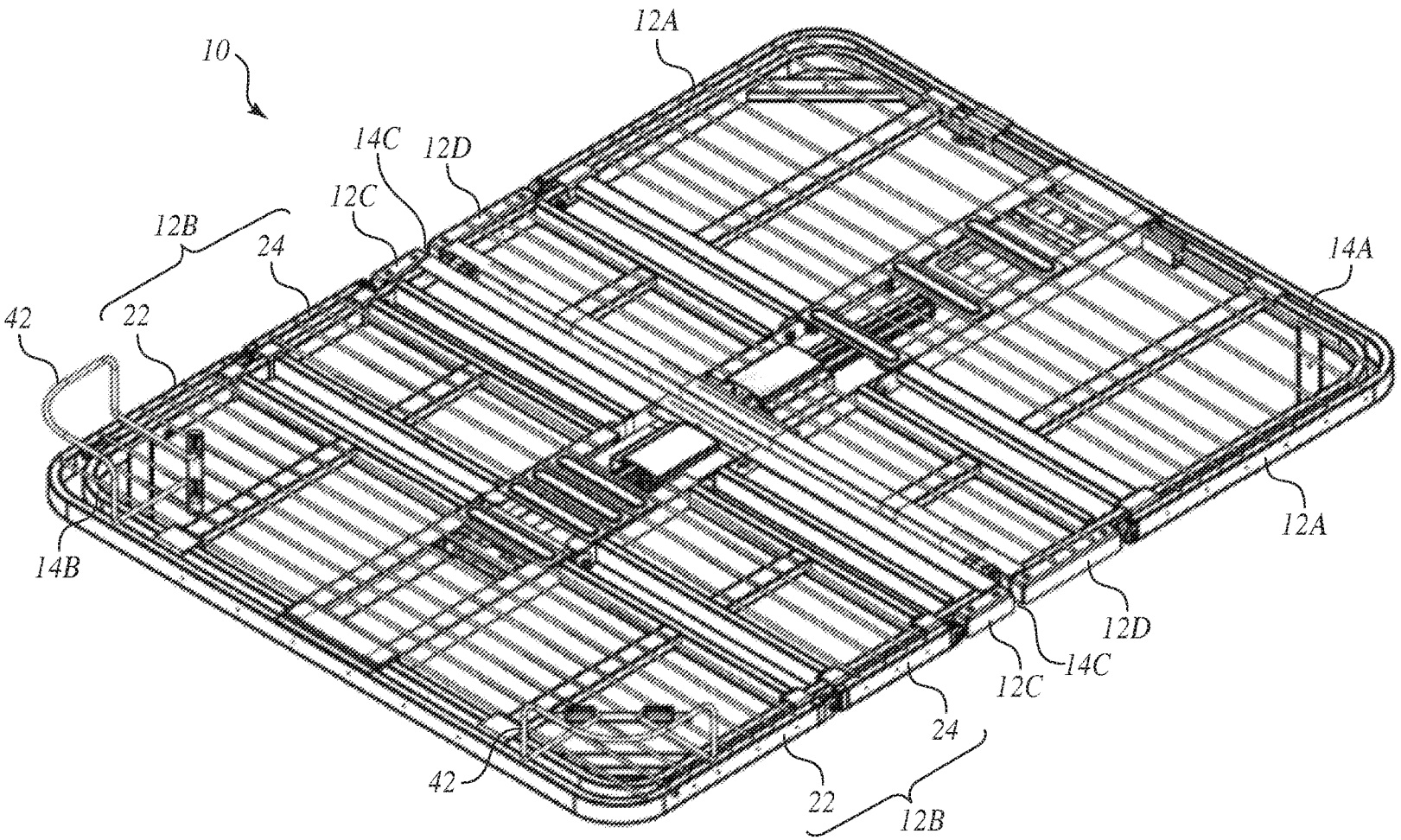
FIG. 1 is an isometric view of the adjustable power bed layer of the invention in a flattened state.
Figure 3:
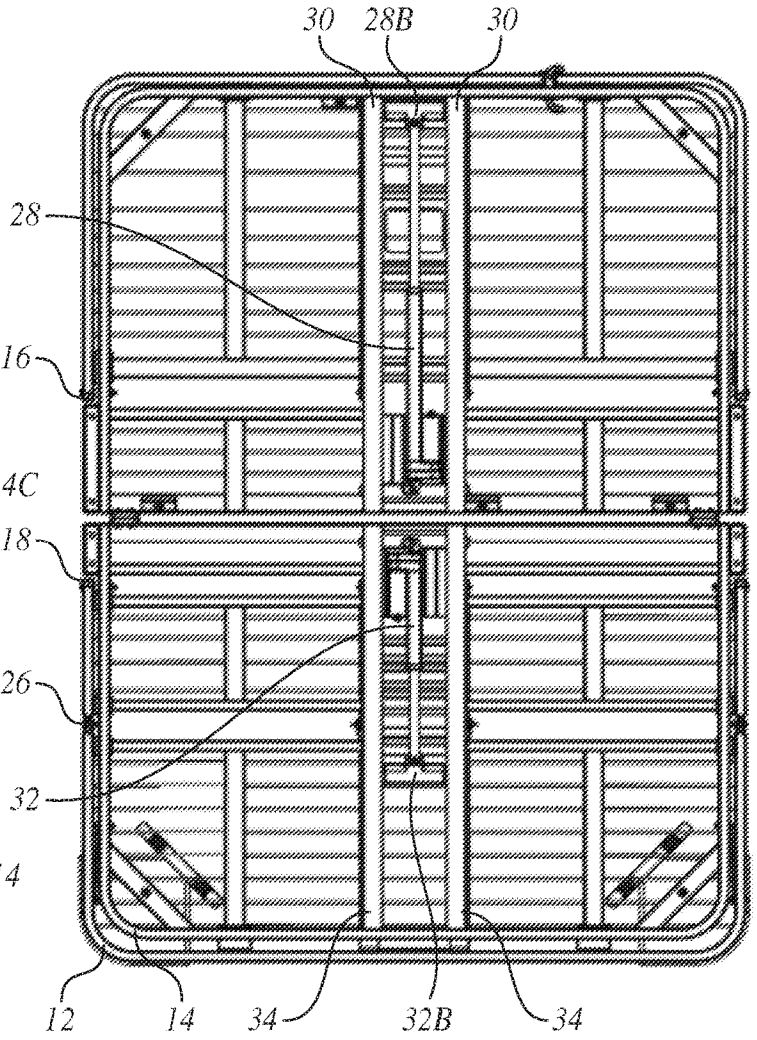
FIG. 3 is a bottom view thereof in the flattened state.
Figure 2:
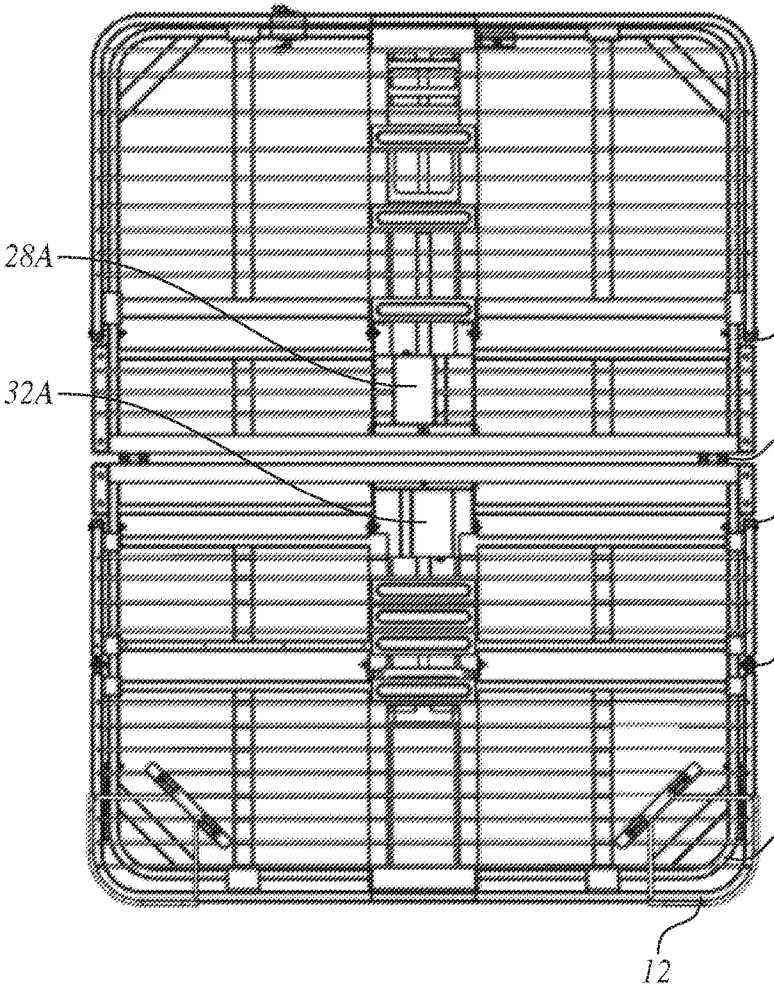
FIG. 2 is a top view thereof in the flattened state.
Figure 4:
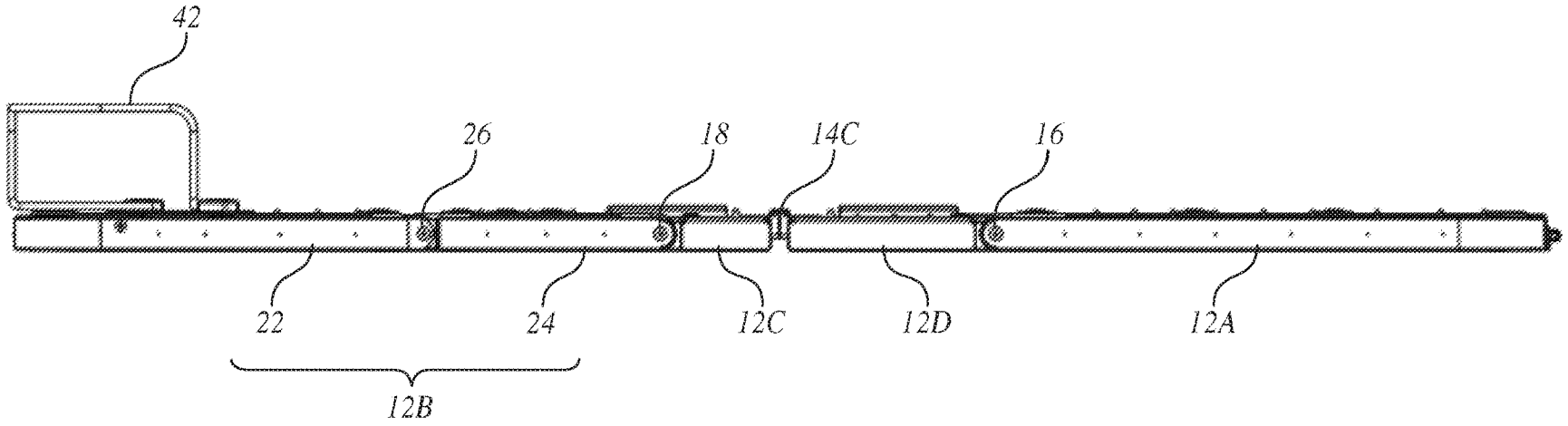
FIG. 4 is a right side view thereof, which is symmetric to the left side view thereof in the flattened state.
Figure 5:
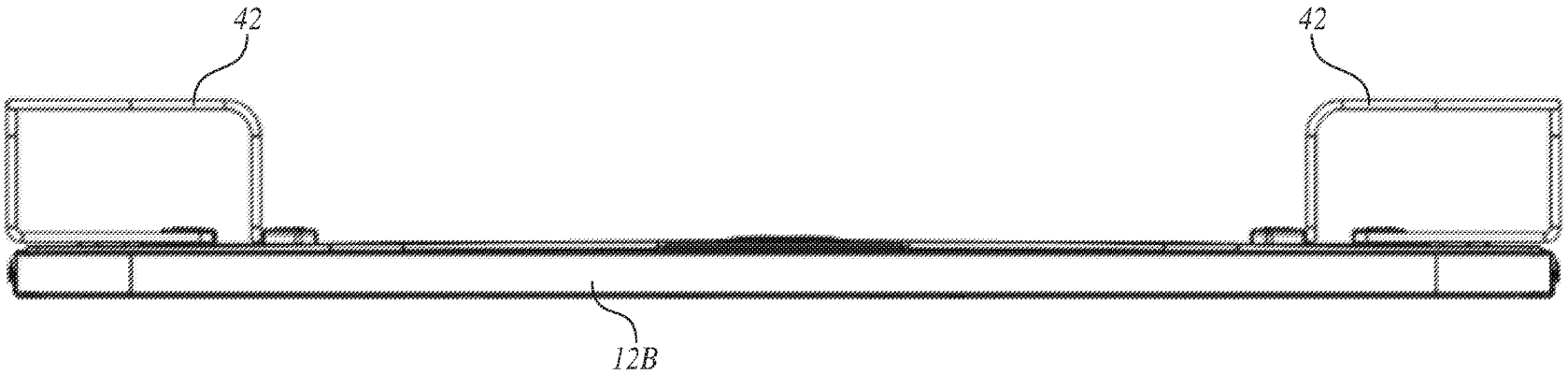
FIG. 5 is a front view thereof in the flattened state.
Figure 6:
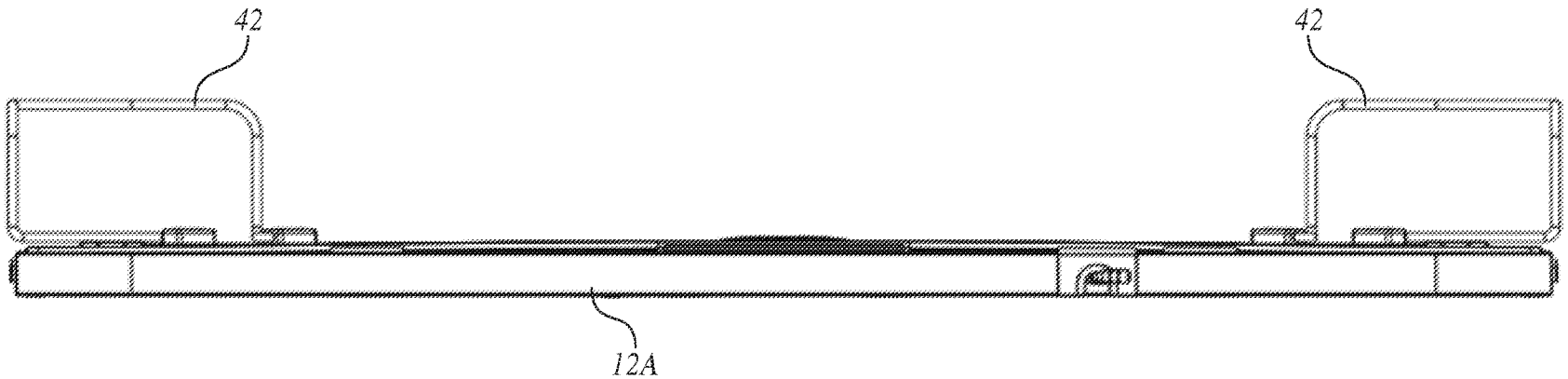
FIG. 6 is a back view thereof in the flattened state.
Figure 7:
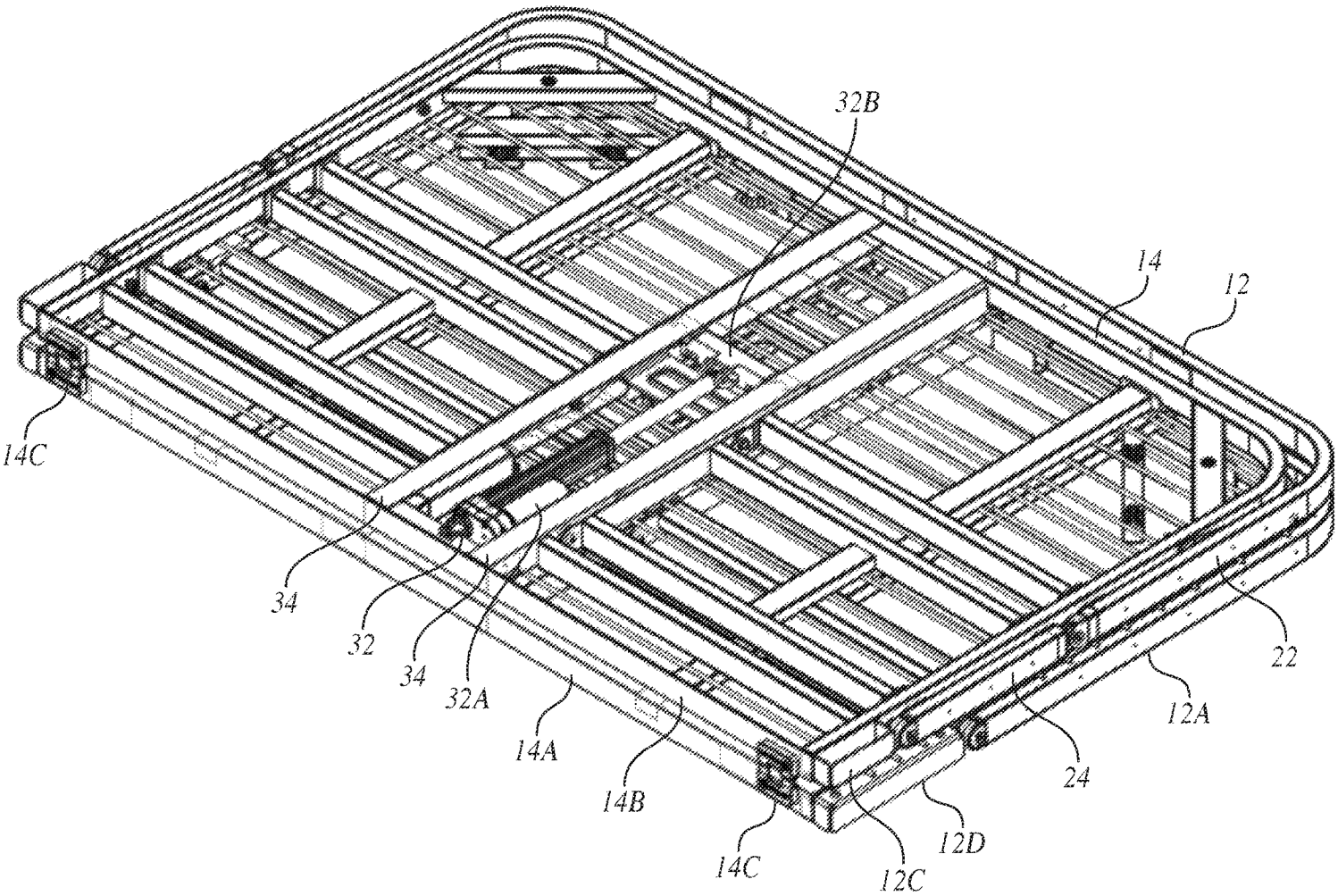
FIG. 7 is an isometric view of the adjustable power bed layer of FIG. 1 but in a folded state.
Figure 9:
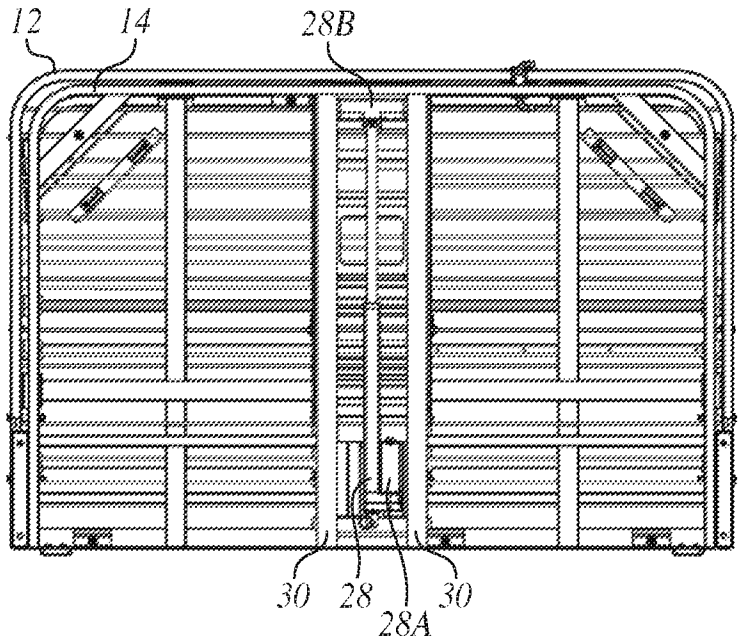
FIG. 9 is a bottom view thereof in the folded state.
Figure 8:
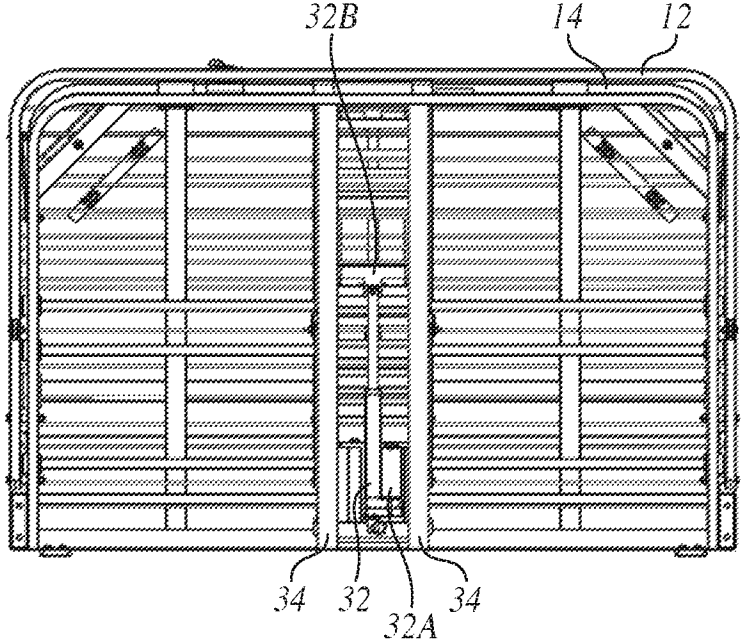
FIG. 8 is a top view thereof in the folded state.
Figure 10:
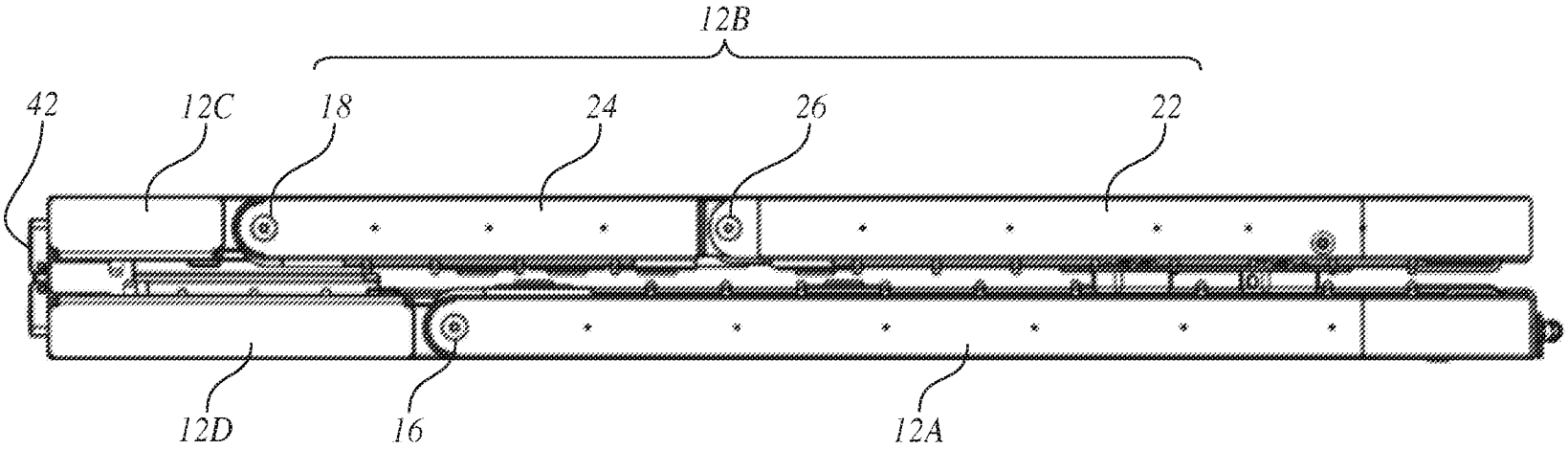
FIG. 10 is a right side view thereof, which is symmetric to the left side view thereof in the folded state.
Figure 11:
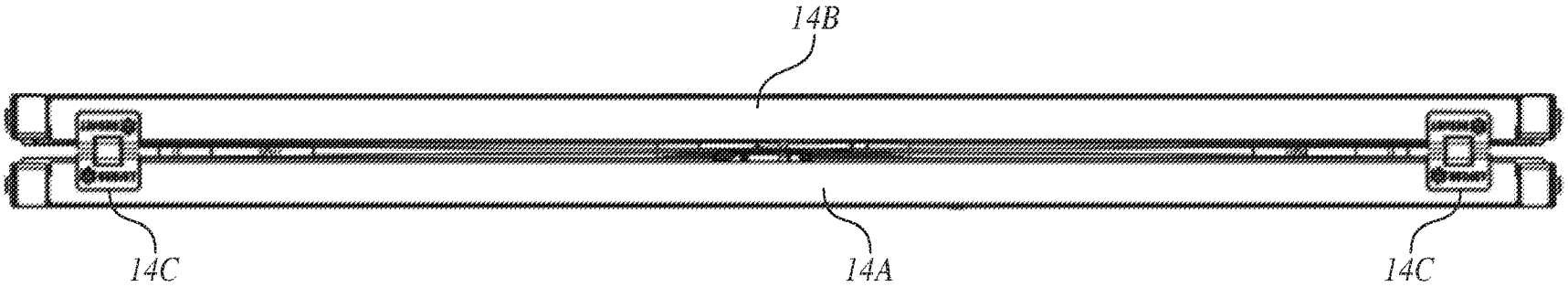
FIG. 11 is a front view thereof in the folded state.
Figure 12:
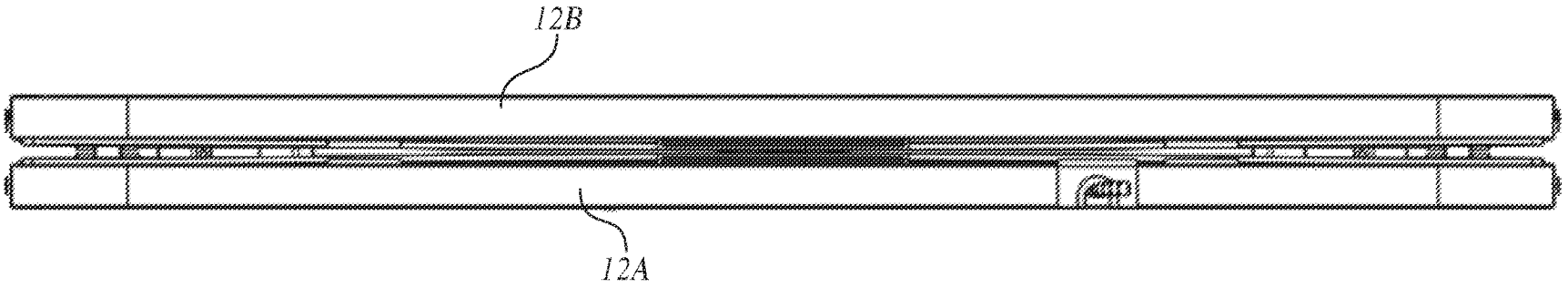
FIG. 12 is a back view thereof in the folded state.
Figure 13:
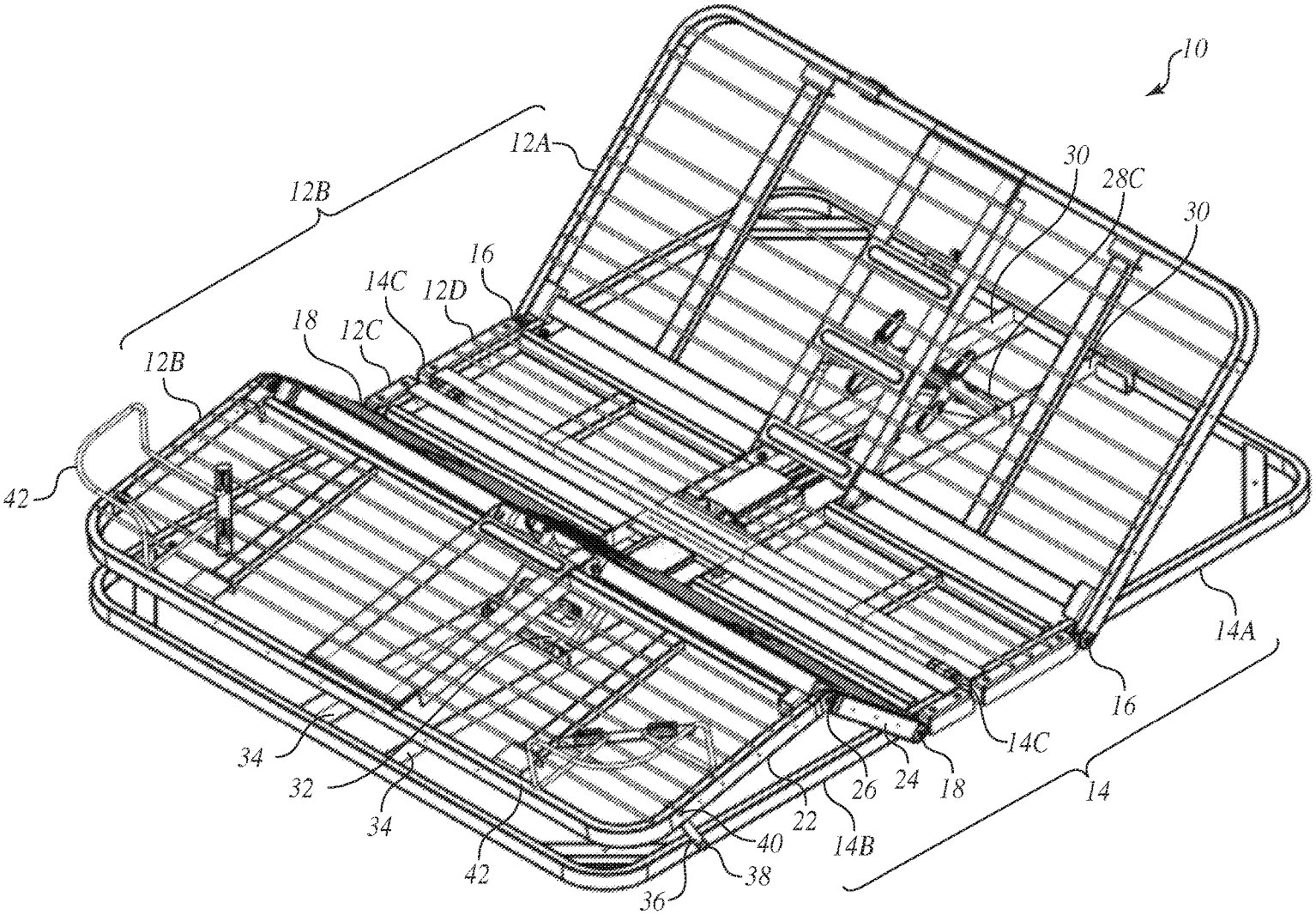
FIG. 13 is an isometric view of the adjustable power bed layer of FIG. 1 but in an adjusted state.
Figure 15:
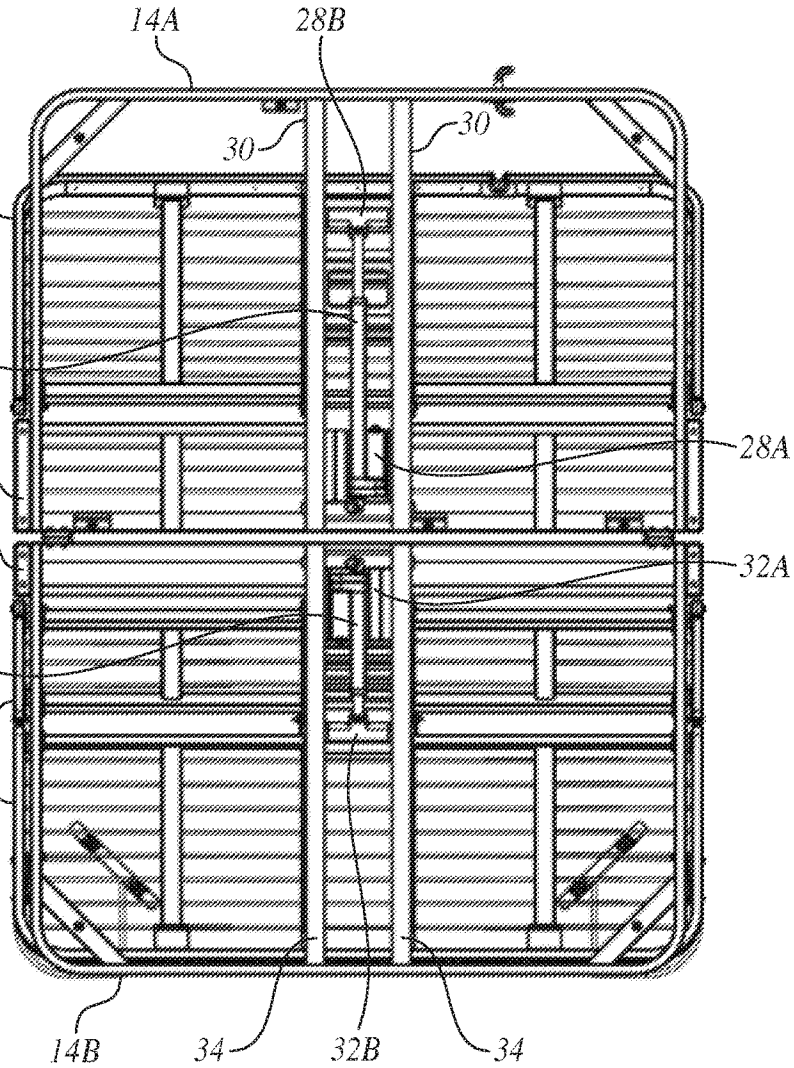
FIG. 15 is a bottom view thereof in the adjusted state.
Figure 14:
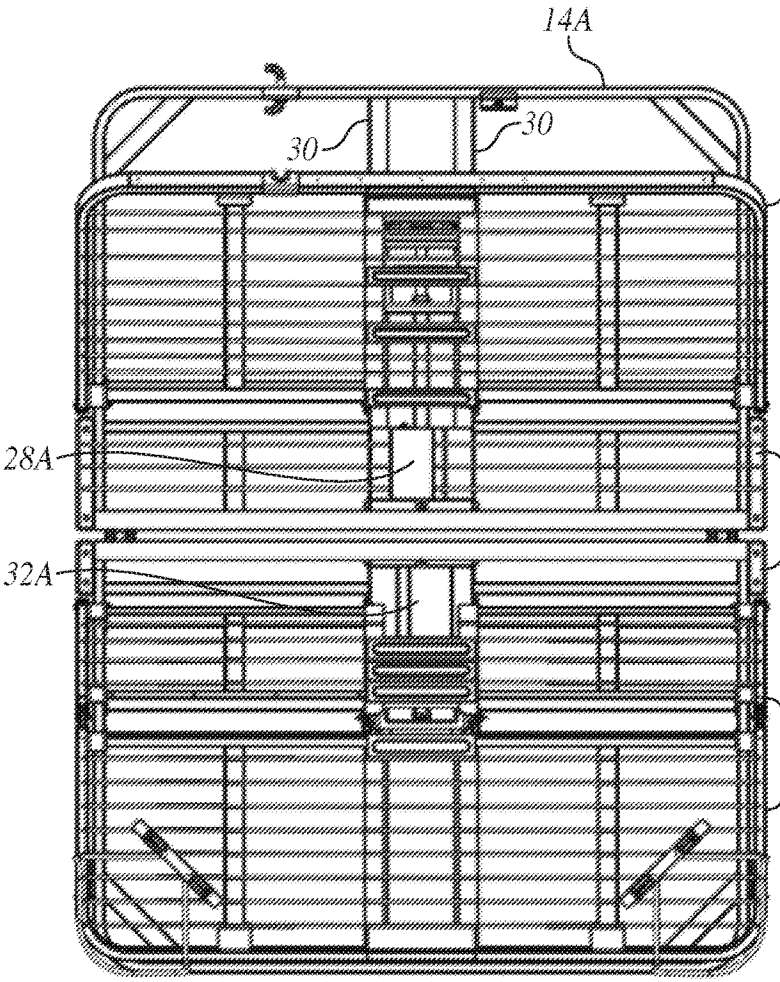
FIG. 14 is a top view thereof in the adjusted state.
Figure 16:
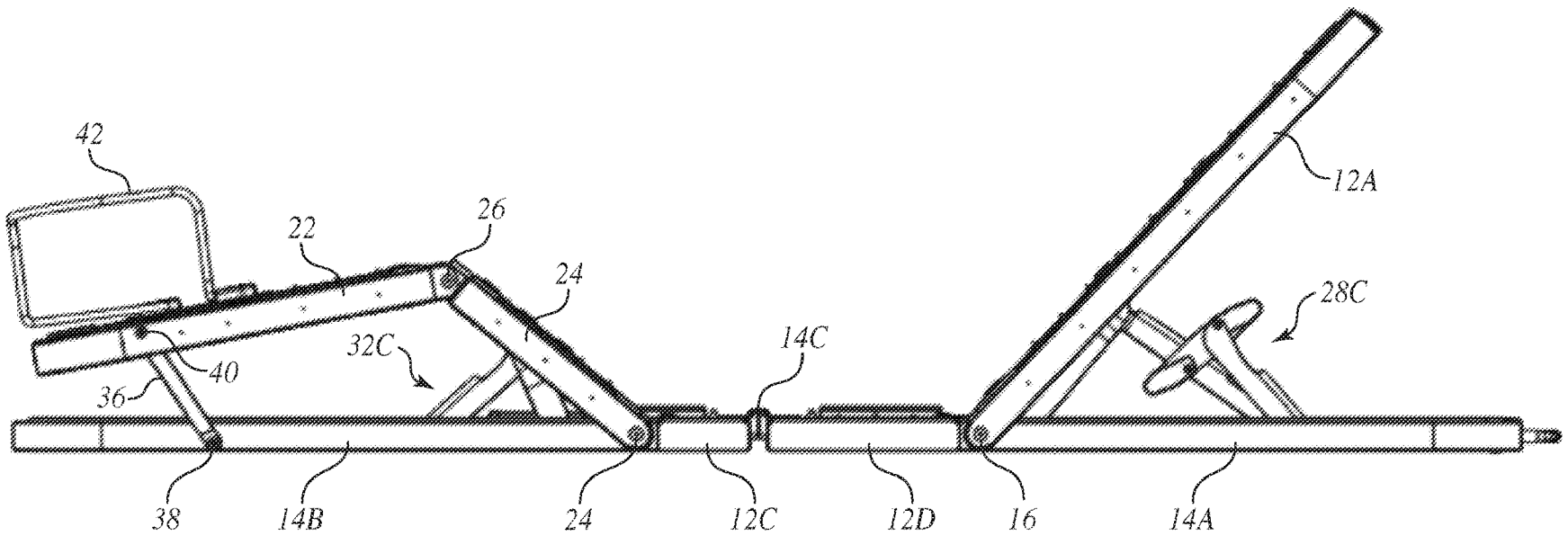
FIG. 16 is a right side view thereof, which is symmetric to the left side view thereof in the adjusted state.
Figure 18:
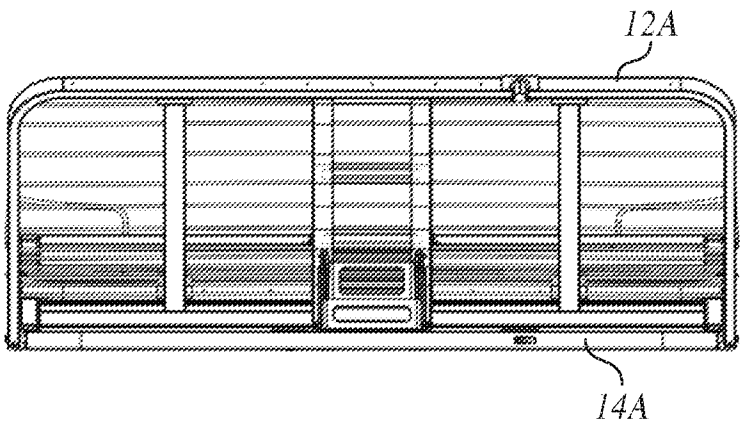
FIG. 18 is a back view thereof in the adjusted state.
Figure 17:
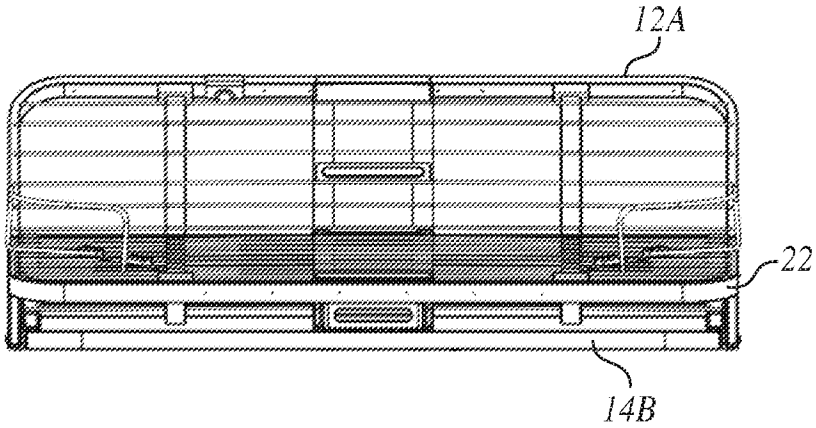
FIG. 17 is a front view thereof in the adjusted state.
Figure 19:
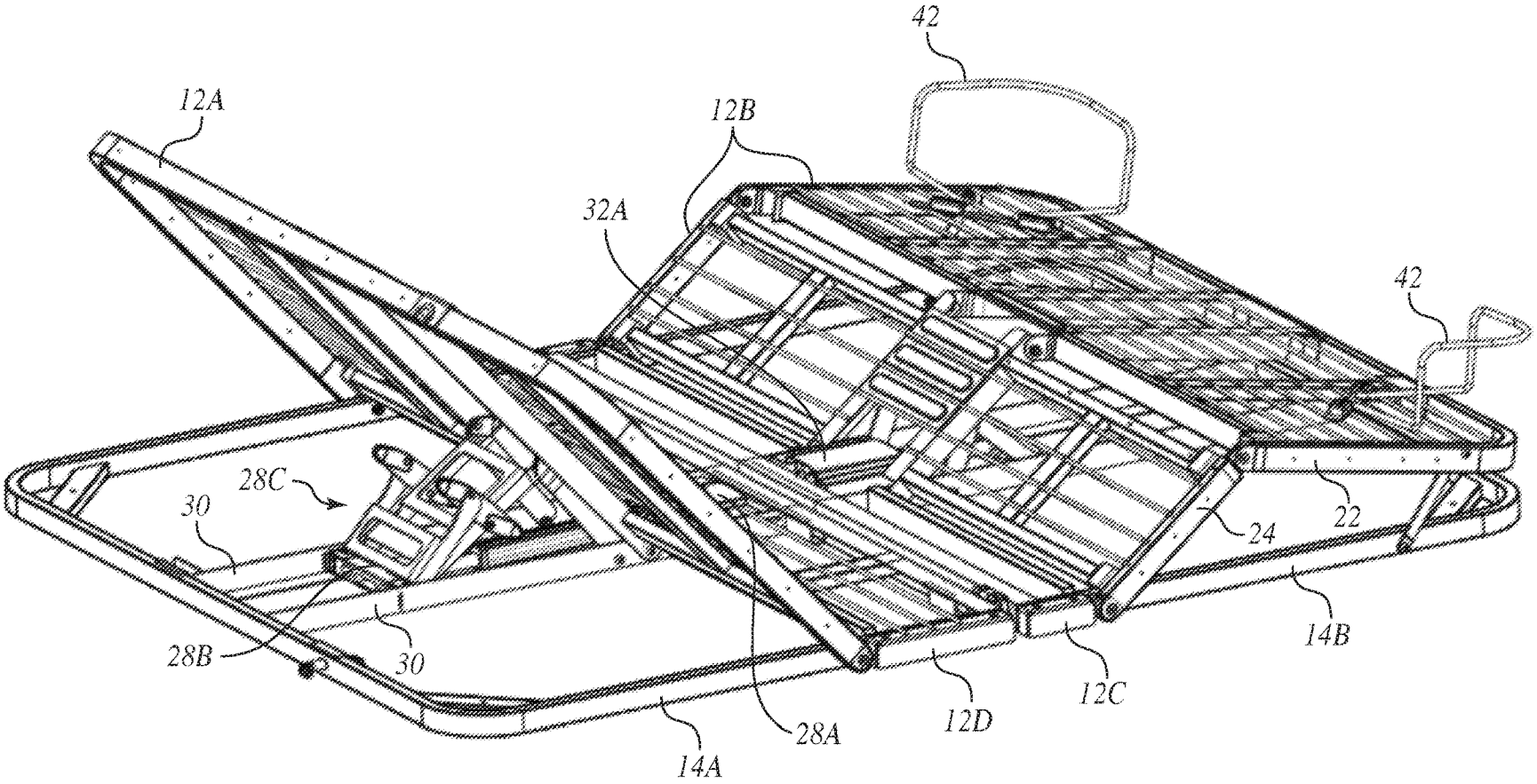
FIG. 19 is a reverse isometric view to that of FIG. 13 in the adjusted state.
Figure 20:
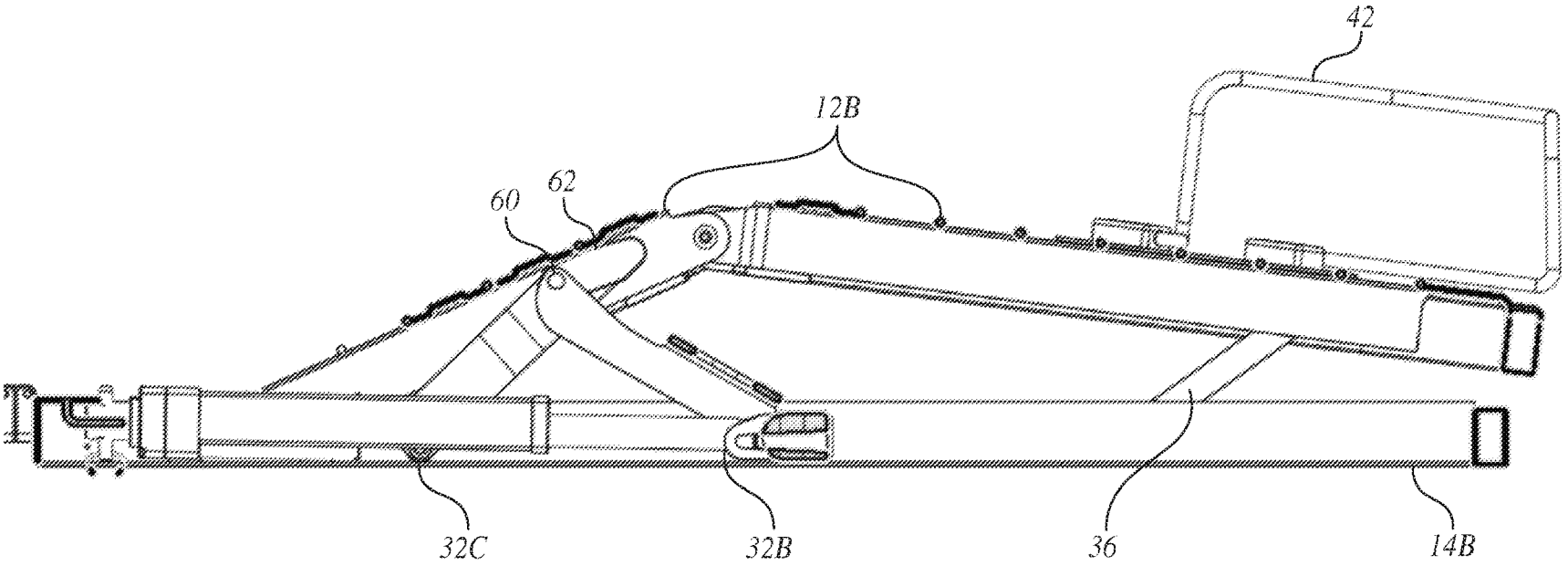
FIG. 20 is a partial sectional view of the foot side of the bed frame in a partial adjusted orientation.
Figure 21:
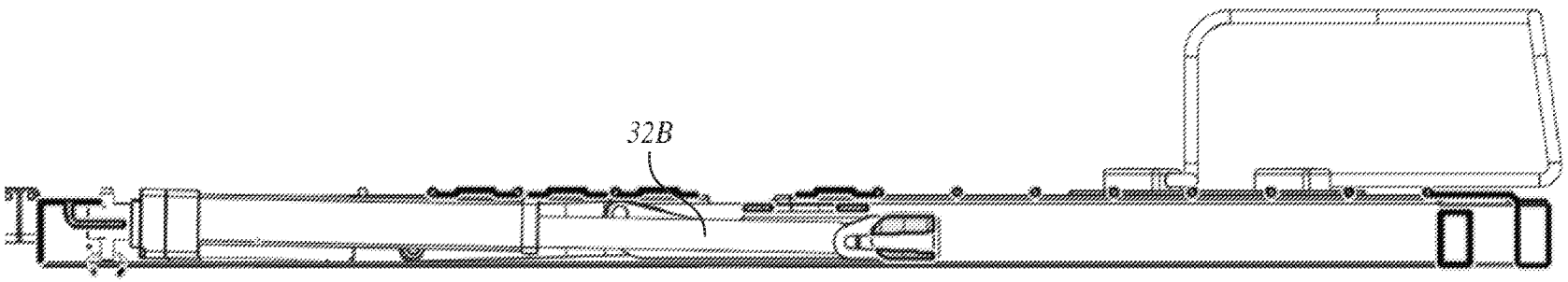
FIG. 21 is a partial sectional view of FIG. 20 but in a fully flattened orientation.
Figure 22:
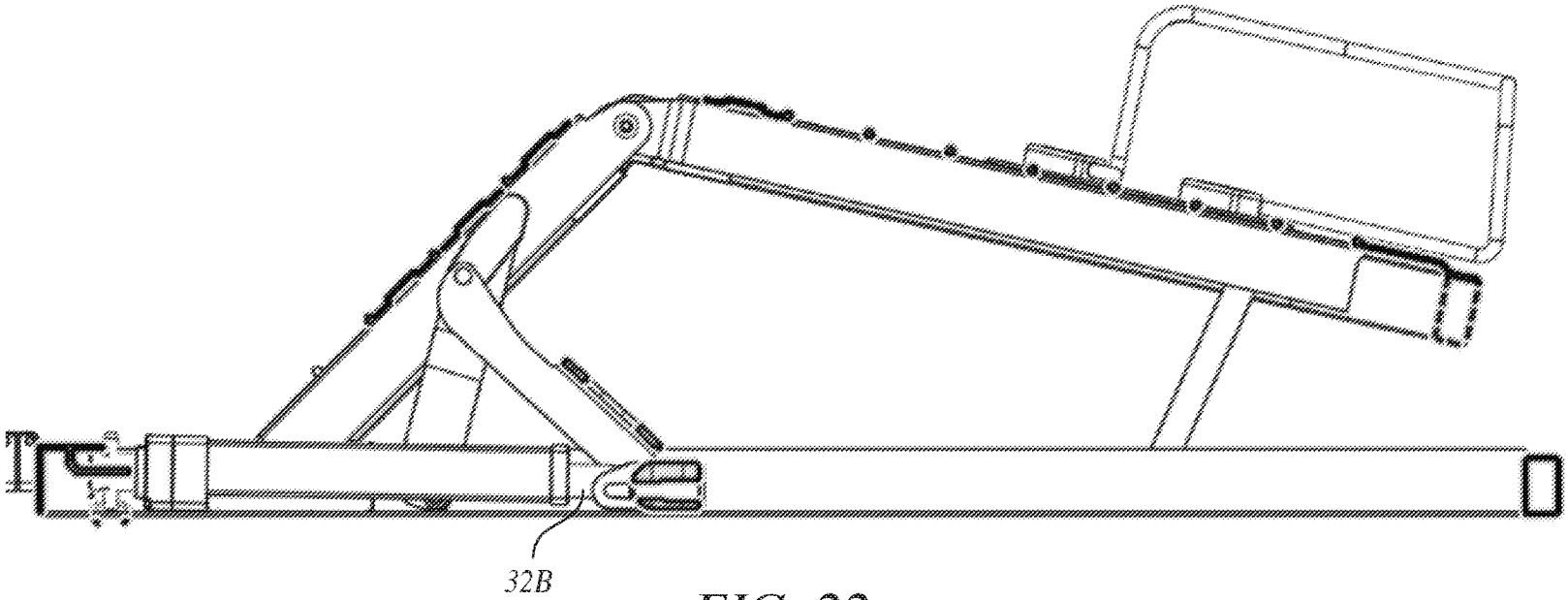
FIG. 22 is a partial section view of FIG. 20 but in a fully adjusted orientation that is fully inclined at 45 degrees.

Turning to the drawings, they all show the adjustable power bed layer 10 of the invention. FIGS. 1-6, 7-12 and 13-19 may be grouped as depicting the adjustable power bed layer 10 of the invention respectively in its "flattened" state, "folded" state and "adjusted state". FIGS. 20-22 show the foot-side of the adjustable power bed layer 10 of the invention in respective intermediate, fully flattened and fully adjusted states. FIGS. 23-28 show the combination of the adjustable power bed layer 10 under a mattress having a fitted sheet.

The adjustable power bed layer 10 has two support frames, namely, an outer frame 12 and an inner frame 14. The outer frame 12 includes a head-side articulating frame 12A, a foot-side articulating frame 12B and two center frames 12C, 12D. The inner frame 14 includes a head-side stationary frame 14A and a foot-side stationary frame 14B that are pivotally connected to each other via hinges 14C.

There are folding hinges 16 between one of the two center frames 12D and the head-side articulating frame 12A. There are folding hinges 18 between the foot-side articulating frame 12B and the other of the two center frames 12C. The foot-side articulating frame 12B has two sections 22, 24 between which are folding hinges 26. Folding hinges 16, 18 and 26 each axially connect the outer frame 12 to the inner frame 14. There are also links 36 pivotally connected via hinges 38 to the foot-side stationary frame 14B and via hinges 40 to the section 22 of the foot-side stationary frame 12B.

Opposite corner regions of the section 22 of the foot-side outer frame 12B are mattress retainer bars 42 that retain a mattress in place to rest on top. The mattress retainer bars 42 are connected to pivoting hinges on the foot-side outer frame 12B. They can lift up and allow the mattress fitted sheet to be tucked under them, hiding them as can be understood from FIGS. 23-28.

Figure 23:
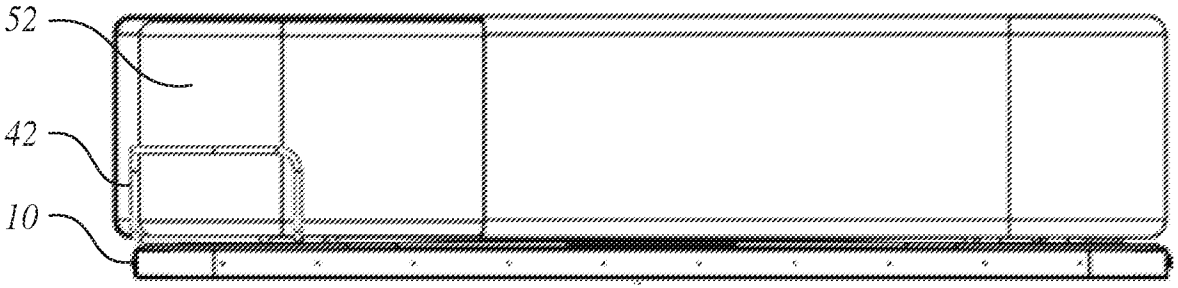
FIG. 23 is a side view of a combination of mattress with fitted sheet on the adjustable bed power layer of FIG. 1 with the latter in the flattened state.
Figure 24:
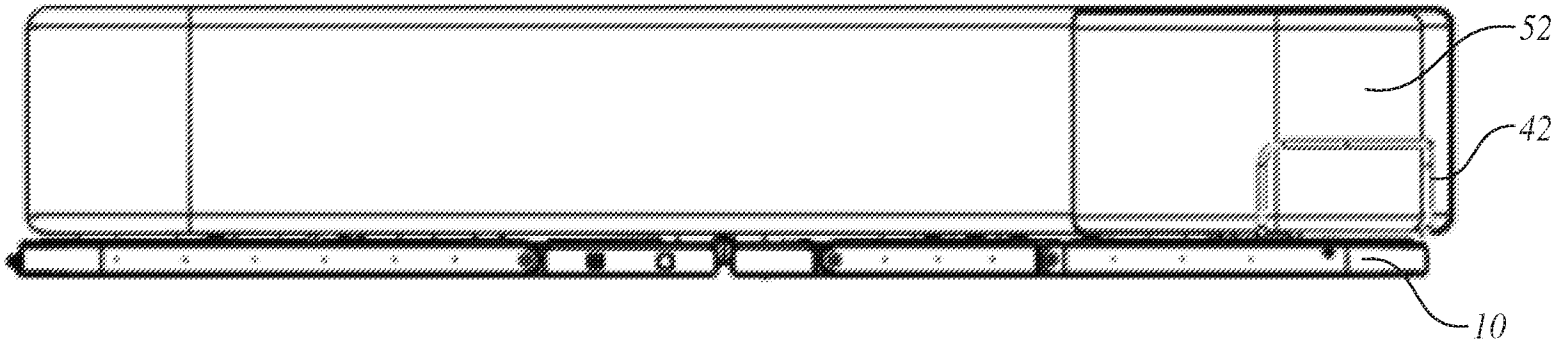
FIG. 24 is a front view of the combination of FIG. 23.
Figure 25:
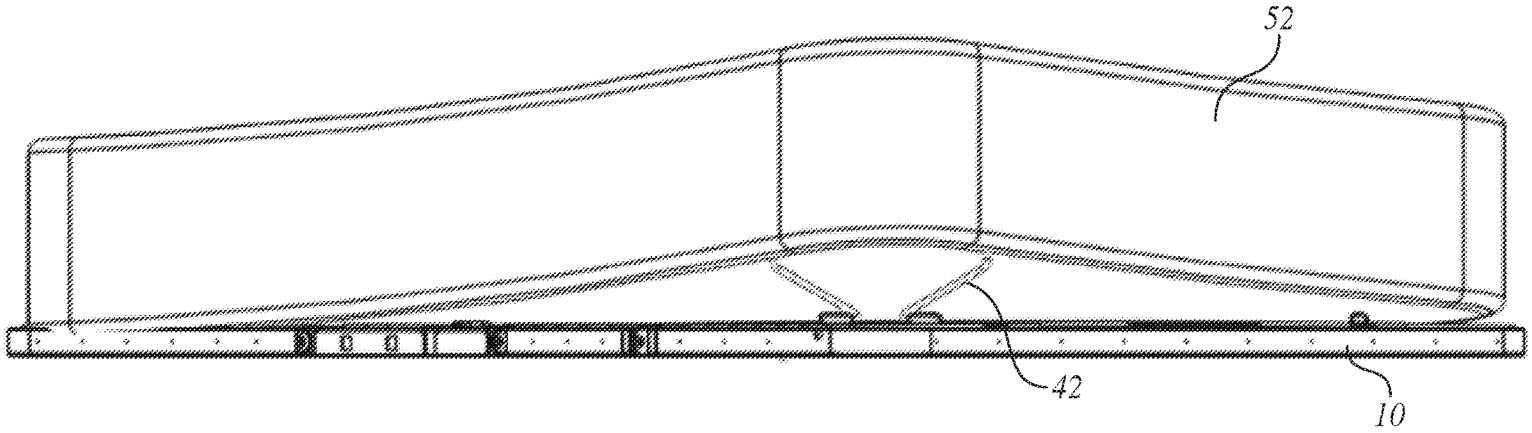
FIG. 25 is a corner view of the combination of FIGS. 23 and 24 but with the corner in a raised position to show that the fitted sheet wraps around and under the mattress and retainer bar, but with the corner region of the mattress raised above the adjustable bed power layer.
Figure 26:
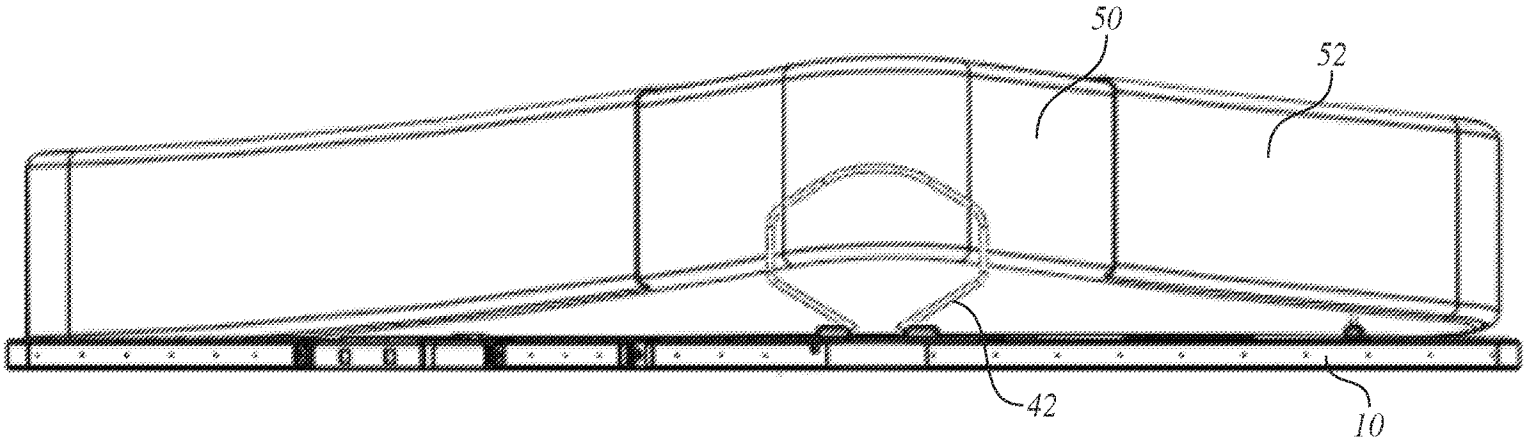
FIG. 26 is the corner view of FIG. 25 but with the fitted sheet cutaway to show more of the retainer bar.
Figure 27:
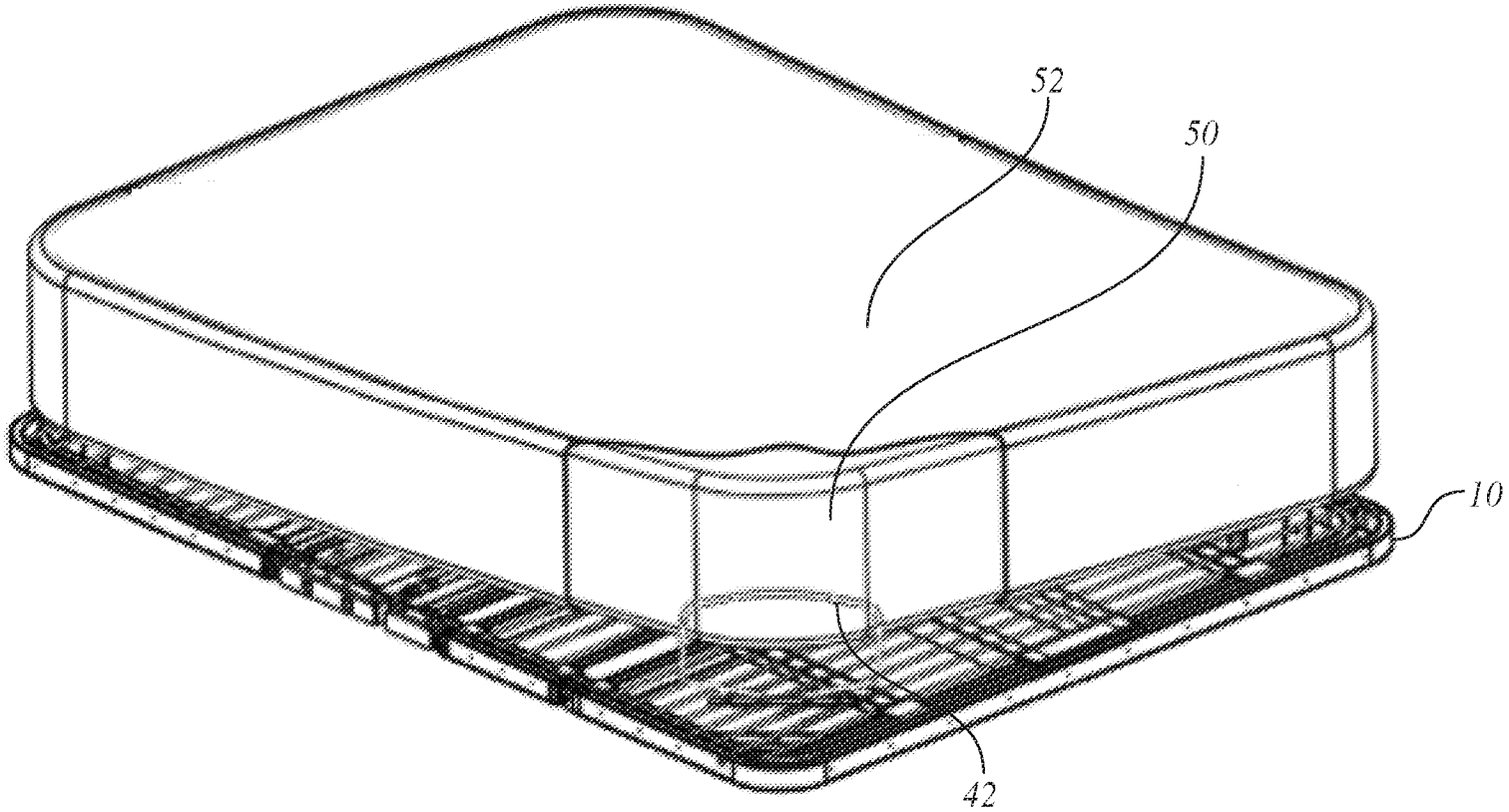
FIG. 27 is an isometric view of FIG. 28 but with the corner region resting upon the adjustable power bed layer.
Figure 28:
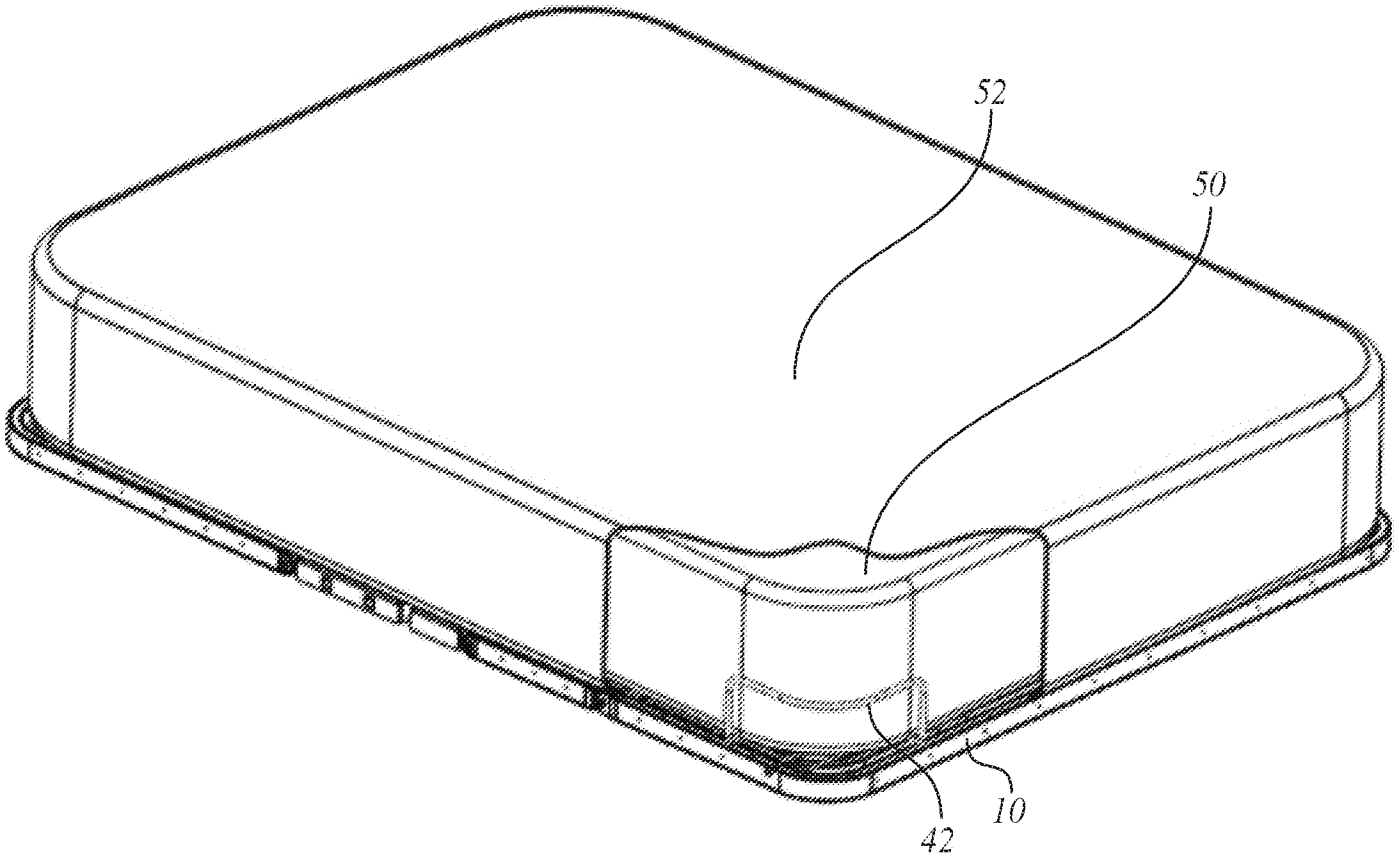
FIG. 28 an isometric view as in FIG. 27, but with the combination rotated 90 degrees.

Turning to FIGS. 23-28, a combination of adjustable power bed layer 10 and mattress 50 with fitted sheet 52 are shown, with the mattress 50 being fitted with the fitted sheet 52 and being upon the adjustable power bed layer 10. While FIGS. 23 and 24 show the combination ready for use, FIGS. 25 and 26 are illustrative views that lift a corner to help grasp the relation between the retainer bars 42 and the mattress 50 with fitted sheet 52. The retainer bar 42 is up against the mattress and is covered by the fitted sheet 52. The retainer bar 42 pivots to lift the mattress. With the mattress so lifted, the fitted sheet tucks around and under the mattress and the retainer bar. FIGS. 26 and 27 have the fitted sheet 52 cut away in the corner region to reveal the retainer bar 42 underneath.

There is also a head-side actuator 28 that includes a head-side motor 28A that imparts a force to drive a head-side sliding member 28B (such as a pull bar) to slide back and forth along a track 30. There is a head-side connected structure 28C that operatively connects pivotally the head-side sliding member 28B and the head-side articulating frame 12A. Thus, the head-side connected structure 28C moves in unison with the head-side driven member 28B to pivot the head-side articulating frame 12A about the folding hinges 16 to travel between its flattened and adjusted states.

There is also a foot-side actuator 32 that includes a foot-side motor 32A that imparts a force to a foot-side sliding member 32B (such as a pull bar) to slide back and forth along a track 34. There is a foot-side connected structure 32C that operatively connects pivotally the foot-side sliding member 32B and the foot-side articulating frame 12B. Thus, the foot-side connected structure 32C moves in unison with the foot-side sliding member 32B to pivot the foot-side articulating frame 12B about the folding hinges 18 to travel between its flattened and adjusted states. Such pivoting action about the folding hinges 18 also result in pivoting action about the hinges 26 because the foot-side articulating frame 12B has the two sections 22, 24 pivotally connected to each other at the hinges 26, with section 22 pivotally connected via the hinges 40 to the links 36, which are pivotally connected via the hinges 38 to the foot-side inner frame 14B.

The outer frame 12 nests about the inner frame 14. The actuators 28 and 32 remain within a height of the inner frame 14 during an entirety of the sliding movements of the respective head-side and foot-side connected structures in the respective tracks 30, 34. That is, the actuators 28 and 32 remain within confines of a volume defined between upper and lower planes of the articulated bed frame and bounded on the sides and ends by the outer and inner frames 12, 14 of adjustable bed frame 10. During an entirety of a lifting movement of the articulating frame, the associated actuator remains above the lower plane of the adjustable bed frame 10.

The inner frame 12 folds in half at the folding hinges 16, without requiring the use of tools to do so. The actuators 28. 32 remain in the same plane as the inner frame 14 in its flattened condition throughout the lifting procedure for the mattress. As an alternative, the actuators 28, 32 each start flat within the same plane as the inner frame 14 and then raise slightly above the plane of the inner frame 14 during the lifting procedure.

The lifting procedure can be appreciated from the drawings that show the flattened state (FIGS. 1-6) and the adjusted state (FIGS. 13-19) as well as from the sectional views (FIGS. 20-22). The respective connected structures 28C, 32C, which are operatively connected to the actuators 28, 32 via respective sliding members 28B, 32B that slide along their respective tracks 30,34 to change the orientation of the adjustable power bed layer 10 from the flattened state to the adjusted state and vice versa. By sliding the respective connected structures 28C, 32C, which are operatively connected to the actuators 28, 32, toward the center, both the head-side outer frame 12A raises and the foot-side outer frame 12B raise into the adjusted state from the flattened state.

Turning to FIG. 20, the foot-side of the adjustable power bed layer 10 has one stage that varies in lift force capacity and lift speed, which is dependent on the linkage angle and contact point of the cam/wing to the frame. The foot-side sliding member 32B, which is an actuator pulling structure, moves horizontally causing the linkages to lift vertically. As the bed angle increases, the point of contact moves from the initial lift contact point of the linkage pivot point 60 (of the foot-side connected structure 32C) towards the tip of the contact surface after initial lift of the wing/cam 62 (of the foot-side connected structure 32C).

Easy access to the underside of the adjustable power bed layer 10 of the invention is available—by folding the adjustable power bed layer 10 from the flattened state (FIGS. 1-6) which would be resting on a mattress box spring, bed frame or platform bed frame, to the folded state (FIGS. 7-12). That is, the inner frame 14 can be folded about the folding hinges 16 so that whichever is desired to be on top as between the head-side inner frame 14A and foot-side inner frame 14B, such folding will expose the applicable one of the actuators 28, 32 to become accessible from above. Thus, the folded adjustable power bed layer 10 allows for maintenance of the applicable one of the actuators 28, 32 as needed without the need for completely removing the adjustable power bed layer 10 in its entirety from its installed location on the bed and flipping it over. That is, the adjustable power layer 10 remains in its position but merely half of it is folded over at one time to allow maintenance to proceed as needed.

There are no legs required for the adjustable power bed layer, which may be placed on any flat surface, such as the top surface of a box spring, a platform bed or bed frame with a distributed support surface.

While the foregoing description and drawings represent the preferred embodiments of the present invention, it will be understood that various changes and modifications may be made without departing from the scope of the present invention.

SEQUENCE LISTING

Not applicable.

What is claimed is:

1. An adjustable power bed layer, comprising:

an adjustable bed frame having two articulating frames each pivotally movable between flattened and adjusted orientations and separated from each other with a central frame interposed between the two articulating frames;

two actuators that drive two sliding members respectively to undertake respective sliding back and forth motions; and two connected structures pivotally connecting the two sliding members respectively with respective ones of the two articulating frames to move in unison with the sliding back and forth motions of the two sliding members respectively to thereby pivot the two articulating frames to move between the flattened and adjusted orientations as the central frame remains stationary throughout an entirety of the sliding back and forth motions of the two sliding members wherein the sliding members slide away from the center frame to the flattened orientation and slide towards the center frame to the adjusted orientation.

2. The adjustable power bed layer of claim 1, wherein the adjustable bed frame has two halves pivotally connected to each other, wherein the two halves are pivotally movable between flattened and folded states so that in the flattened state, the two halves spread out substantially in a planar manner relative to each other with one of the two actuators at an underside of at least one of the two halves and in the folded state, the two halves rest one over the other with the one of the two actuators being at a topside of the two halves and thus accessible from above.

3. The adjustable power bed layer of claim 1, wherein the adjustable bed frame also has a stationary frame relative to which the two articulating frames pivot between the flattened and adjusted orientations so that in the flattened orientation, the two actuators remain within confines of a volume bounded by the adjustable bed frame and between upper and lower planes of the adjustable bed frame that are spaced apart from each other by dimensions of the stationary frame, the two actuators remaining above the lower plane during an entirety of movement of the two articulating frames.

4. The adjustable power bed layer of claim 1, wherein the adjustable bed frame has an inner frame and an outer frame pivotally connected to each other to move between a flattened state, at which the inner and outer frames nest with each other, and a folded state, at which the inner and outer frames fold one over another, the two articulating frames being part of one of the inner and outer frames, the other of the inner and outer frames having tracks connected thereto and along which slide the two sliding members to effect the sliding back and forth motions.

5. The adjustable power bed layer of claim 4, wherein one of the two articulating frames has two portions pivotally connected to each other that define a reflex angle between the two portions in the adjusted orientation.

6. The adjustable power bed layer of claim 5, further comprising;

a link pivotally connecting one of the two portions to one of the inner and outer frames.

7. The adjustable power bed layer of claim 1, further comprising:

at least one mattress retainer bar pivotally connected to the one of the two articulating frames so as to pivot into an orientation that allows a fitted sheet to be tucked under and cover the at least one mattress retainer bar; and a fitted sheet tucked under and covering the at least one mattress retainer bar.

8. The adjustable power bed layer of claim 1, wherein the adjustable bed frame also includes a further central frame interposed between and separating the two articulating frames from each other, the first-mentioned central frame and the further central frame together constituting two central frames, the two articulating frames being pivotally connected to respective ones of the two central frames to move between the flattened and adjusted orientations, the two articulating frames each defining respective reflex angles of inclinations from the respective ones of the two central frames so as to incline in a diverging manner away from the two central frames, each of the two central frames remaining stationary throughout an entirety of movement of the two articulating frames.

9. The adjustable power layer of claim 1, wherein the adjustable bed frame lacks any legs connected thereto.

10. A method of assembling an adjustable power bed layer, comprising:

pivotally moving two articulating frames of an adjustable bed frame between flattened and adjusted orientations;

separating the two articulating frames from each other by a central frame interposed between the two articulating frames;

actuating two actuators to drive two sliding members respectively to effect sliding back and forth motions of the sliding members; and moving two connected structures, which pivotally connect the two sliding members and the two articulating frames respectively, in unison with the sliding back and forth motions of the two sliding members respectively to pivotally move the two articulating frames between the flattened and adjusted orientations as the central frame remains stationary throughout an entirety of the sliding back and forth motions of the two sliding members wherein the sliding members slide away from the center frame to the flattened orientation and slide towards the center frame to the adjusted orientation.

11. The method of claim 10, wherein the adjustable bed frame has two halves pivotally connected to each other, further comprising:

pivoting the two halves to move between flattened and folded states so that in the flattened state, the two halves spread out substantially in a planar manner relative to each other with one of the two actuators at an underside of at least one of the two halves and in the folded state, the two halves rest one over the other with the one of the two actuators being at a topside of the two halves and thus accessible from above.

12. The method of claim 10, wherein the adjustable bed frame also has a stationary frame relative to which the two articulating frames pivot between the flattened and adjusted orientations so that in the flattened orientation, the two actuators remain within confines of a volume bounded by the adjustable bed frame and between upper and lower planes of the adjustable bed frame that are spaced apart from each other by dimensions of the stationary frame, the two actuators remaining above the lower plane during an entirety of movement of the two articulating frames.

13. The method of claim 10, wherein the adjustable bed layer has an inner frame and an outer frame pivotally connected to each other, further comprising:

moving the inner and outer frames between a flattened state, at which the inner and outer frames nest with each other, and a folded state, at which the inner and outer frames fold, the two articulating frames being part of one of the inner and outer frames, the other of the inner and outer frames having tracks connected thereto, the two sliding members effecting the sliding back and forth motions along the tracks.

14. The method of claim 13, wherein the one of the two articulating frames has two portions pivotally connected to each other that define a reflex angle between the two portions in the adjusted orientation.

15. The method of claim 14, further comprising;

pivoting a link that pivotally connects one of the two portions to one of the inner and outer frames.

16. The method of claim 10, further comprising:

pivoting at least one mattress retainer bar, which is pivotally connected to the one of the two articulating frames, into an orientation;

tucking a fitted sheet under the at least one mattress retainer bar and covering the at least one mattress retainer bar with the fitted sheet.

17. The method of claim 10, wherein the adjustable bed frame also includes a further central frame separating the two articulating frames from each other, the two articulating frames being pivotally connected to respective ones of the two central frames, the first-mentioned central frame and the further central frame together constituting two central frames; further comprising:

moving the two articulating frames between the flattened and adjusted orientations so that the two articulating frames each define respective reflex angles of inclinations from the respective ones of the two central frames and incline in a diverging manner away from the two central frames.

18. The method of claim 10, wherein the adjustable bed frame lacks any legs connected thereto.

* * * * *